US005154367A

United States Patent [19]

Beisswanger

[11] Patent Number: 5,154,367

[45] Date of Patent: Oct. 13, 1992

[54] WEB WINDER HAVING DRIVEN CAMS TO RELIEVE ROLLER PRESSURE

[75] Inventor: Rudolf Beisswanger, Steinheim, Fed. Rep. of Germany

[73] Assignee: J. M. Voith GmbH, Heidenheim, Fed. Rep. of Germany

[21] Appl. No.: 680,501

[22] Filed: Apr. 4, 1991

[30] Foreign Application Priority Data

Apr. 5, 1990 [DE] Fed. Rep. of Germany ..... 4011009

[51] Int. Cl.[5] ..... B65H 18/16

[52] U.S. Cl. ..... 242/65

[58] Field of Search ..... 242/65, 66, 75.2

[56] References Cited

U.S. PATENT DOCUMENTS

| | | | |
|---|---|---|---|
| 3,116,031 | 12/1963 | Moore et al. | 242/65 X |
| 3,258,217 | 6/1966 | MacArthur et al. | 242/65 |
| 3,524,603 | 8/1970 | Hughes, Jr. | 242/65 |
| 4,546,930 | 10/1985 | Rohde et al. | 242/65 X |
| 4,632,325 | 12/1986 | Feyerl et al. | 242/65 X |
| 4,634,068 | 1/1987 | Malkki et al. | 242/65 |
| 4,979,689 | 12/1990 | Snygg | 242/65 |

*Primary Examiner*—Daniel P. Stodola

*Assistant Examiner*—John F. Rollins

*Attorney, Agent, or Firm*—Baker & Daniels

[57] ABSTRACT

A winder for winding a running web on a winding drum having a journal at each end. Each one of a pair of primary levers has a fork at one end for receiving one of the journals. As the roll is progressively wound, the winding drum is swivelable from a first position situated generally above the backing roll to a second position offset from the first position by an angle of about 90 degrees. The winding drum is received from the primary levers at a pair of secondary levers at the second position. A generally horizontal guideway for the drum extends from the second position to a third position. The roll and the winding drum are forced onto the backing roll by a contact pressure device. A driven cam plate is coordinated with each of the primary levers so that a cam plate and the primary lever at least partially pass a primary section between said first and second positions, thereby relieving part of the pressure on the winding drum and roll wound thereon in accordance with the contour of the roll, and according to the distance of travel negotiated from the first position to the second position.

4 Claims, 1 Drawing Sheet

WEB WINDER HAVING DRIVEN CAMS TO RELIEVE ROLLER PRESSURE

BACKGROUND OF THE INVENTION

The invention concerns a winder for the winding of a running web of paper, foil or the like. A backing roll, a winding drum on which the web is wound into a roll, and a first pair of swivel levers (primary levers) are utilized in the winder. The primary levers each feature on an end a fork for receiving a journal of the winding drum, and are mounted with the other end in the area of the backing roll axis in such a way that the winding roll, in swiveling from a first position above the backing roll in the running direction of the web about the backing roll, approaches the latter and passes a primary section. The winding roll then reaches a second position in which the winding drum, with the as yet incomplete paper roll, is taken over by a second pair of swivel levers (secondary levers), with an essentially horizontal guideway extending from the second position via a secondary setting to a third position. A contact pressure device forces the winding drum with the paper roll being created thereon onto the backing roll.

Such winders, also called "Pope rollers," form generally the final section of a paper machine, serving to fashion the paper web accruing there into a roll form. But they are also used for rewinding an already completed roll so as to create a new roll.

In each case, the roll is to have very specific properties, particularly as concerns the winding hardness. Starting from a certain initial value, the winding hardness is to diminish to a limit value. This reduction is supposed to be maximally uniform from the first lap to the last. The reduction is to exhibit a specific gradient, i.e., it should not be too heavy nor should it be too light. The progression of the winding hardness should at no rate display jumps, such as a sudden drop.

All of this has so far been sought but not achieved. Instead, winders of known design produce rolls where the core is extremely hard. As a result, this core becomes unusable because the web is overextended in this area and breaks, so that this part must be discarded as scrap.

Prior means for influencing the winding hardness are two measures which are used, for instance, on slitters. One measure provides for subjecting the web during winding to a more or less heavy tension. The other measure consists in forcing the roll more or less heavily down on the backing roll, for instance by applying pressure on the axles of the winding drum or by applying contact pressure with a rider roll which is arranged parallel to the roll created and forced on it, so that a line pressure is created between the paper roll and the backing roll.

Frequently, a line pressure is generated between the roll being created and the backing roll, in the said primary section, by the weight of the paper roll. The paper roll is extremely heavy, reaching a dead weight of several tons, so that a correspondingly high line pressure is created. This line pressure is responsible for the extremely high winding hardness of the core of the roll.

In order to somewhat reduce the line pressure, and thus also the winding hardness in the core area, relief devices for the winding drum/paper roll have already been used which are supposed to act in the sense of uplifting the winding drum/paper roll and thus of a reduction of the line pressure. Theoretically, this is the case. Due to the inevitable vibrations of the entire machine during operation, however, a "dancing" occurs so that the relief can be performed only with care—and thus with little effectiveness—in order to prevent the winding drum/paper roll from jumping out of the forks of the first two swivel levers.

Thus, the problem of the excessively hard core has so far remained unmanageable. The problem could not be solved either by accelerating the winding drum/paper roll prior to unwinding a new roll, to winding speed, in the upper apex area of the backing roll until the peripheral speed of the winding drum/paper roll and backing roll were synchronized. Neither has it so far been possible to solve the other problem, namely the. aforementioned steep drop of the winding hardness in the limit range. Especially unfavorable in the course of the entire winding is the time span of transferring the created roll from the primary section to the secondary section. During this time span, the winding hardness is practically outside any control.

The problem underlying the invention is to give a winder a design such that the winding hardness will have the desired progression from start to completion of the roll, i.e., that the extreme hardness in the core area will be avoided, and that the winding hardness is under control at any moment of the winding process. Additionally, of course, the mechanical expense is to be held as low as possible.

SUMMARY OF THE INVENTION

This problem is solved by the features of the present invention. A pair of cam plates is provided, each of which is coordinated with a primary lever. Together with a cam plate the primary lever will pass the primary section, at least partly, thereby relieving the winding drum/paper roll in accordance with its contour and according to the travel distance negotiated. A drive is coordinated with the cam plates, wherein the drive rotates both plates about a horizontal axis.

In greater detail, the following is achieved with the invention:

Use of the cam plates achieves an exactly dosable relief of the large roll weight. The two cam plates may act, for instance, on an axis of the winding drum/paper roll. Since they are connected with the primary levers, they pass the primary distance. Turning about their own horizontal axis makes it possible to exactly determine the measure by which the effect of the deadweight of the winding drum/paper roll is reduced. The rotation of the two cam plates about their own axis may for instance be so fashioned that first, in the upper apex area and thus in the first position, no contact takes place yet between the shell surface of the backing roll and the shell surface of the winding drum/paper roll, but that this occurs after the passage of several angular degrees of the primary levers. Next, the line force between the winding drum/paper roll and the backing roll can be dosed exactly by further rotation of the cam plate, at any time, that is, at any point of the distance negotiated.

It is quite important that the inventional device be able to position the winding drum/paper roll in such a way that its shell surface (or the shell surface of the paper wound up) assumes a finite distance from the shell surface of the backing roll, and that this distance can be selectively varied continuously up to, finally, the contact between the two said shell surfaces. This inventional property is decisive in winding pressure-sensitive papers, for instance so-called NC papers (=without carbon paper) or in the case of high-quality coated papers.

BRIEF DESCRIPTION OF THE DRAWINGS

The drawing shows a so-called Pope roller showing a primary and secondary lever, and showing a first, second and third position of the winding drum according to the features of the present invention.

DESCRIPTION OF THE PREFERRED EMBODIMENT

Figure 1:
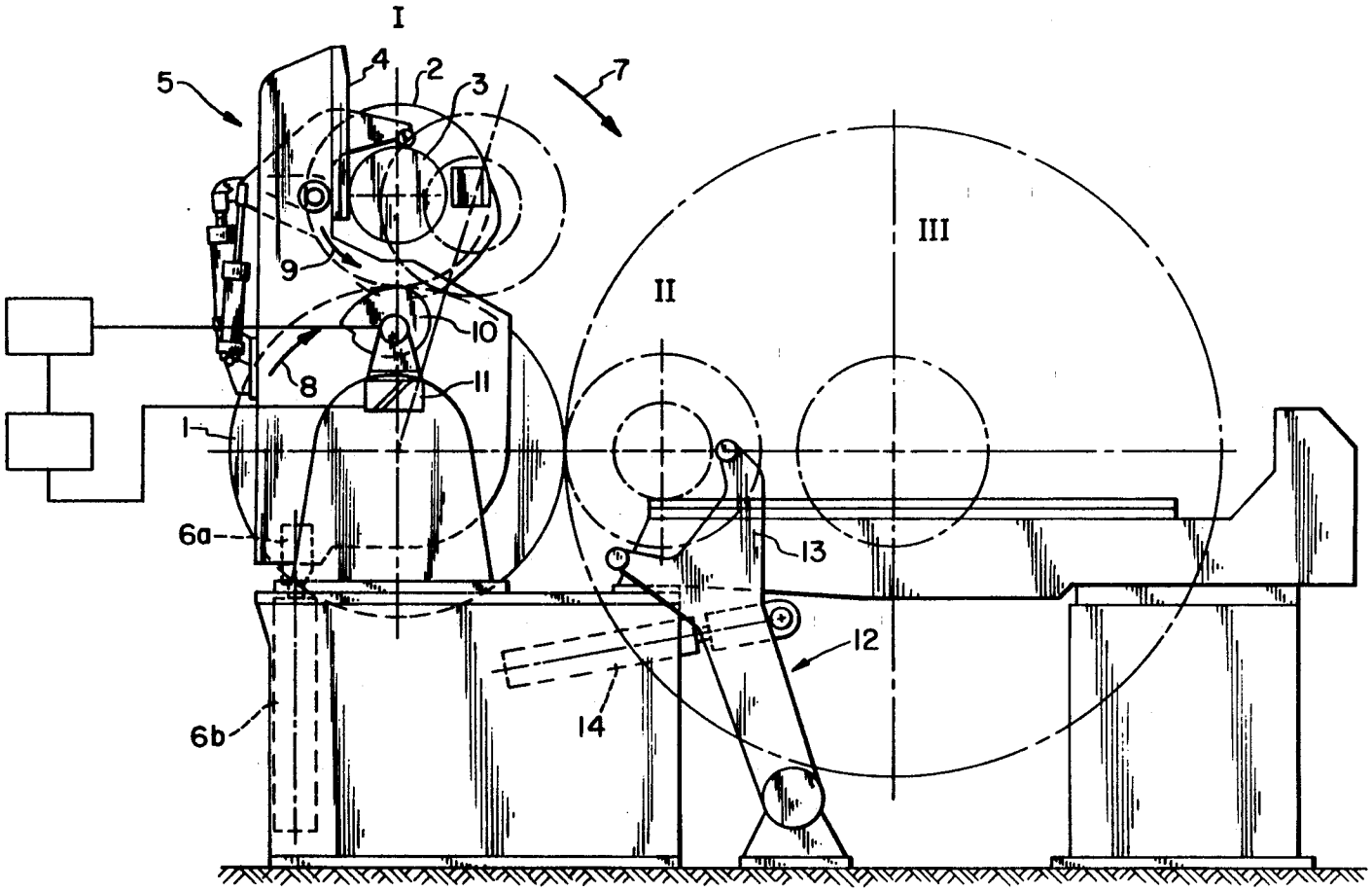

The Pope roller shown in the drawing serves the winding of a running paper web. The paper web is not illustrated here, but only the roll formed from it. In the drawing, the paper web is fed to the Pope roller from the left.

The Pope roller features a backing roll 1 having the width of the web. A winding drum 2 has on both of its ends journals 3. Each journal is mounted in the fork 4 of a primary (swivel) lever 5. Thus, located as well in the area of the front ends of the backing roll 1 and thus also of the winding drum 2, the primary levers can be swiveled, by means of a pneumatic drive 6*b*, about a pivot 60 on a circular path according to arrow 7. The pivotal center of the primary levers 5 may be somewhat offset relative to the axis of rotation of the backing roll 1. But it is an advantage of the invention that both may be concentric to each other.

The winding drum 2 is located first in its position I, either exactly or nearly exactly perpendicularly above the backing roll 1. In this position it is still empty, i.e., with no paper wrapped around it yet.

The backing roll 1 is then driven in the direction of arrow 8, and with it the winding drum 2 in the direction of arrow 9. Along with it, the paper web is being wound more and more on the drum 2. Under the weight of the drum/paper roll 2, quite considerable forces act on the paper web. These forces quite decisively influence the winding hardness of the roll being created. As the roll gains in weight along its way according to arrow 7, this weight is effective, too, in influencing the winding hardness.

According to the invention, a cam plate each is provided in the area of the ends of the drum 2. Each of the two cam plates 10 are mounted on one of the two primary levers 5, thus following the swivel motion of the primary levers 5. The cam plates 10 act, directly or indirectly, on the drum/paper roll 2. They bear either on its shell surface, in the marginal area, mark well, or against its journals 3.

Between each of the cam plates 10 and the pertaining primary lever 5 there is a load cell 11 provided that measures the force prevailing between the drum/paper roll 2 and the cam plate 10. The mode of operation of the cam plate 10 and of the load cell 11 will be addressed hereinafter.

In the course of the operation of the Pope roll, the two primary levers 5 proceed together with the winding drum 2 and the partial paper roll contained on it, as mentioned above, in the direction of arrow 7, proceeding thereby from the position I of the winding drum/paper roll to its position II. In position II, the curved movement of the winding drum with the partial roll comes to an end. Here, the winding drum 2 with the partial roll is transferred from the primary lever pair to a secondary lever pair 12. Each secondary lever comprises as well a fork 13 for receiving the respective journal 3 of the winding drum 2. A contact pressure device, such as pneumatic or hydraulic drive 14 acts on the two secondary levers 12 swiveling them to the right, so that the winding drum 2 with the now steadily growing paper roll negotiates a horizontal secondary distance, until it finally reaches the position III where the roll is completed.

Critical in view of the winding result in the entire operation is especially the primary section, that is, the section between positions I and II. Especially critical is the transfer phase from the primary section to the secondary section. The previously encountered problems are now solved with the inventional cam plates 10. The cam plates and, as the case may be, the load cells 11 operate as follows: Both are driven, and at that, on the tending side and on the gear side of the Pope roller in a synchronized way, the drive being controlled by angular encoders. The two cam plates bring about a relief of the winding drum weight as well as the weight of the paper roll being created. Achieved thereby is a specific control of the line force between backing drum 1 and winding drum 2. Utilized as adjustment variables are the angular position of the primary levers 5 and the forces measured on the load cell 11. The winding hardness over the diameter of the paper roll should follow a certain curve. A certain angle of travel in the primary section corresponds to the achievement of a certain roll diameter. Depending upon the winding hardness desired, it is possible to employ a particular angular position of the primary levers. Thus, if a particular hardness is desired at a particular diameter of the roll, then the cam plates may be rotated so as to relieve the pressing force between the paper roll and the winding drum. To this end it is necessary to measure the angular position. Numerous measuring devices which may be utilized to measure the angular position are known in the art.

The inventional device is capable of raising the winding drum/paper roll 2 to an effect such that no contact at all takes place with the backing drum 1. This mode of operation is especially suited for papers that are sensitive to surface pressure, for instance NC paper or high-quality coated papers.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A winder for winding a running web, said web having a width, comprising:

a winding drum on which said web is to be progressively wound into a roll, said winding drum having two ends and having a journal on each of said ends;

a backing roll for said winding drum, said backing roll having a width and further having an axis, said width being substantially the same as the width of said web;

a pair of primary levers, each of said primary levers having two ends and having a fork at one end thereof for receiving a separate one of said journals, each of said primary levers being mounted at the other end thereof in closely spaced relationship with said backing roll axis; said winding drum being swivelable from a first position wherein said winding drum is situated generally above said backing roll in the running direction of the web to a second position wherein said winding drum is offset from said first position by an angle of about 90°, said winding drum approaching said backing roll and passing through a primary section as it passes from said first position to said second position, said web being progressively wound on said winding drum as said drum passes from said first position to said second position;

a pair of secondary levers disposed at said second position, said secondary levers being structured and arranged to receive said winding drum from said primary levers as said drum passes to said second position;

a generally horizontal guideway extending from said second position via a secondary section to a third position;

a contact pressure device for forcing said winding drum and said roll being wound thereon onto said backing roll;

a pair of cam plates, each of said cam plates being coordinated with a separate one of said primary levers so that a cam plate and a primary lever coordinated with said cm plate at least partially pass said primary section, thereby relieving pressure exerted between said backing roll and said winding drum and roll wound thereon in accordance with the contour of said roll and according to the distance of travel negotiated from said first position to said second position; and drive means operably associated with said cam plates for rotating said plates about a horizontal axis.

2. A winder according to claim 1, wherein a force sensor is interposed between each cam plate and the primary lever coordinated with said cam plate.

3. A winder according to claim 2, in which a line force exists between said winding drum and said backing roll, and wherein a control circuit is provided for control of said line force, said control circuit being adjustable in response to the angular position of said cam plates.

4. A winder according to claim 1, in which a line force exists between said winding drum and said backing roll, and wherein a control circuit is provided for control of said line force, said control circuit being adjustable in response to the angular position of said cam plates.

* * * * *